US009109477B2

(12) United States Patent
Caine et al.

(10) Patent No.: US 9,109,477 B2
(45) Date of Patent: Aug. 18, 2015

(54) OIL PUMP DRIVE

(71) Applicant: Ford Global Technologies, LLC, Dearborn, MI (US)

(72) Inventors: Jon Edward Caine, South Woodham Ferrers (GB); Sean Gordon Harman, Southend on Sea (GB); Paul Nigel Turner, Chelmsford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/192,755

(22) Filed: Feb. 27, 2014

(65) Prior Publication Data

US 2014/0238335 A1 Aug. 28, 2014

(30) Foreign Application Priority Data

Feb. 27, 2013 (GB) ..... 1303465.7

(51) Int. Cl.
*F01M 1/02* (2006.01)

(52) U.S. Cl.
CPC ..... *F01M 1/02* (2013.01)

(58) Field of Classification Search
USPC ..... 123/196 R, 198 C; 417/360, 364; 184/6.28
See application file for complete search history.

(56) References Cited

U.S. PATENT DOCUMENTS

| | | | | | |
|---|---|---|---|---|---|
| 3,570,465 | A * | 3/1971 | Masaoka | ..... | 123/185.2 |
| 3,601,226 | A * | 8/1971 | Masaoka et al. | ..... | 184/6.28 |
| 3,857,378 | A * | 12/1974 | Nakamura | ..... | 123/196 R |
| 4,095,579 | A | 6/1978 | Iwasa et al. | | |
| 4,411,227 | A * | 10/1983 | Feichtinger | ..... | 123/196 R |
| 5,078,106 | A * | 1/1992 | Matsuo et al. | ..... | 123/196 R |
| 6,708,664 | B2 | 3/2004 | Ito | | |
| 2007/0277751 | A1 | 12/2007 | Lin et al. | | |
| 2011/0283966 | A1 * | 11/2011 | Zwickler et al. | ..... | 123/196 R |

FOREIGN PATENT DOCUMENTS

| | | | | | |
|---|---|---|---|---|---|
| DE | 3619577 | A1 * | 12/1987 | ..... | F02B 67/06 |
| DE | 102004058248 | A1 * | 7/2006 | | |
| JP | 02207113 | A * | 8/1990 | ..... | F01M 1/06 |
| JP | H0598993 | A | 4/1993 | | |

* cited by examiner

*Primary Examiner* — Hung Q Nguyen

(74) *Attorney, Agent, or Firm* — Julia Voutyras; Alleman Hall McCoy Russell & Tuttle LLP

(57) ABSTRACT

An engine is provided herein. The engine includes a crankshaft, an engine casing, an oil pump, and an accessory drive, the oil pump having an input member which is driven from the crankshaft at a location on the opposite side of the accessory drive to the engine casing.

18 Claims, 3 Drawing Sheets

OIL PUMP DRIVE

CROSS REFERENCE TO RELATED APPLICATION

The present application claims priority to G.B. Patent Application Number 1303465.7, filed on Feb. 27, 2013, the entire contents of which are hereby incorporated by reference for all purposes.

FIELD

This invention relates to an oil pump drive and particularly, but not exclusively, relates to an oil pump drive attached to a crankshaft pulley of an internal combustion engine.

BACKGROUND AND SUMMARY

Oil pumps are used in internal combustion engines. The oil pump circulates engine oil under pressure through oil passages which may, for example, be formed in the engine block, head, shafts and bearing housings, thereby lubricating rotating components of the engine. The oil pumps may be driven via a crankshaft in the engine. Additionally, oil pumps and oil pump drive assemblies may be positioned within an engine casing. However, positioning the oil pump and oil pump drive assembly within the engine casing may increase the size of the engine casing, thereby decreasing the engine's compactness.

As such in one approach an engine is provided. The engine includes a crankshaft, an engine casing, an oil pump and an accessory drive, the oil pump having an input member which is driven from the crankshaft at a location on the opposite side of the accessory drive to the engine casing. In this way, the driving components for the oil pump may be positioned external to the engine casing, thereby increasing the compactness of the engine casing, if desired.

The above advantages and other advantages, and features of the present description will be readily apparent from the following detailed description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

BRIEF DESCRIPTION OF THE DRAWINGS

For a better understanding of the present disclosure, and to show more clearly how it may be carried into effect, reference will now be made, by way of example, to the accompanying drawings, in which.

DETAILED DESCRIPTION

Figure 1:
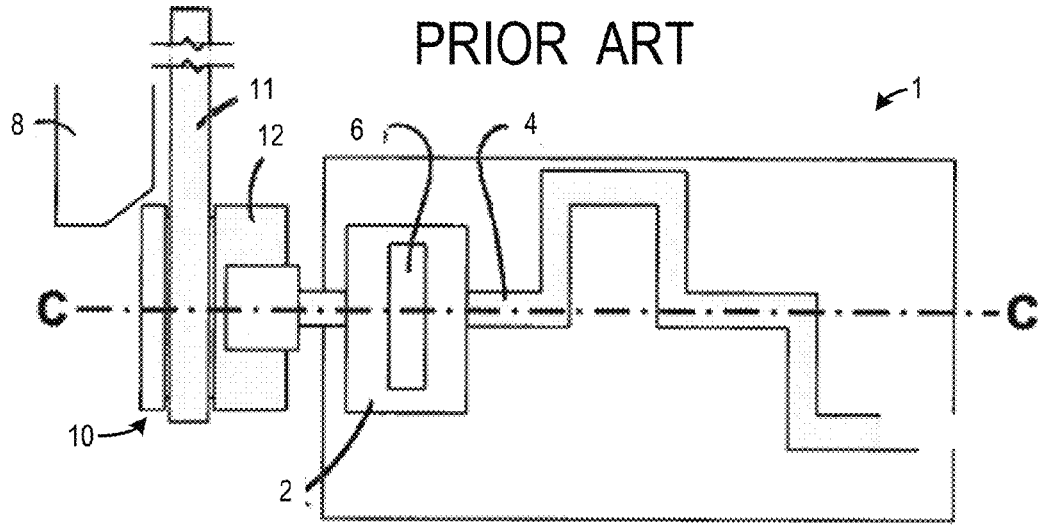
FIG. 1 is a schematic view of a prior art mounting arrangement for an oil pump which is driven directly from the crankshaft of an engine.

An engine (e.g., internal combustion engine) is described herein. The engine includes an engine casing, a crankshaft extending through the engine casing, an accessory drive coupled to the crankshaft, and an oil pump having an input member which is driven from the crankshaft at a location on the opposite side of the accessory drive to the engine casing.

The oil pump input member may be driven from a drive member attached to an end of the crankshaft, in one example. Additionally, the engine may further comprise a drive element, such as a drive band, which transmits drive from the drive member to the oil pump input member. The drive element may comprise a belt, such as a toothed belt or may comprise a chain. As the drive element can be located outside of the oil circuit and oil pan, a dry belt can be used, which may last for the life of the engine.

Furthermore, the drive member may comprise a first drive portion which drives the accessory drive and a second drive portion which drives the oil pump input member. The first drive portion may be a first pulley and the second drive portion may be a second pulley. The first pulley may be of larger diameter than the second pulley.

The engine may further comprise a decoupler which is disposed between the drive member and the crankshaft. The decoupler may comprise a flexible coupling. By using a decoupler, torsional vibrations from the crankshaft are damped, thereby reducing the wear on the components of the oil pump and oil pump drive mechanism. In addition, by reducing the transmission of torsional vibrations, the specified drive element tension can be reduced, thereby reducing the load on the bearings and increasing system efficiency.

The oil pump input member may be disposed below the crankshaft. The drive member may be a crankshaft pulley. Additionally, the oil pump input member may comprise a drive shaft and a pulley. Furthermore, the oil pump input member may extend through a casing of the engine. The oil pump may be driven directly by the oil pump input member.

In an example embodiment, the drive mechanism for the oil pump is moved outboard of the accessory drive and may comprise part of or be formed in the crankshaft pulley, or the oil pump drive mechanism may be attached to the crankshaft pulley. If the oil pump drive is made small enough and is outboard of the main accessory drive plane, it can fit underneath the vehicle side rails, therefore not adding to the effective engine length and enhancing vehicle packaging.

If a decoupling device is used on the crankshaft pulley, which may for example comprise an flexible coupling, cush drive, isolator or one way clutch, the oil pump drive is decoupled resulting in a reduction in torsional vibration from the crankshaft and hence the ability to use lower belt tensions further improving fuel economy and durability. The reduction in torsional excitation may also result in a more smooth oil delivery which in turn is better for lubrication and will result in lower pumping work. By removing the space required on the crankshaft for the oil pump drive, the engine block length can be reduced saving weight and package length, if desired.

Figure 2:
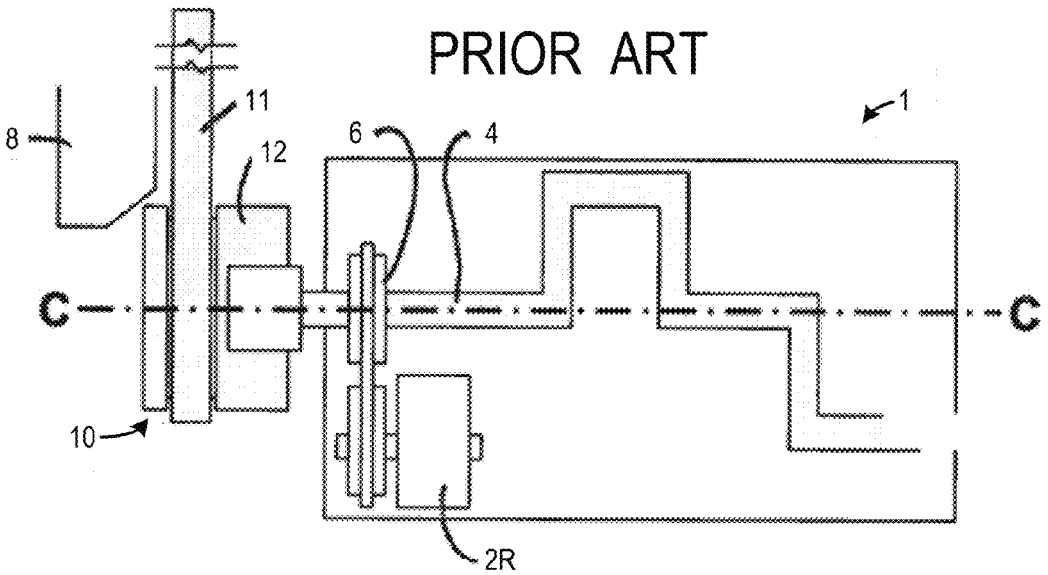
FIG. 2 is a schematic view of another prior art mounting arrangement for an oil pump which is driven from the crankshaft of an engine but is mounted remotely.

FIGS. 1 and 2 show depictions of prior art engines. Specifically, FIG. 1 shows an oil pump 2 mounted directly on a crankshaft 4 of an engine 1. FIG. 2 shows a remotely mounted oil pump 2 driven from a crank.

As shown in the prior art engine depiction in FIG. 1, the oil pump 2 is mounted directly onto the crankshaft 4. The oil pump 2 has to be made sufficiently large to accommodate the crankshaft 4, as well as an internal oil pump drive member 6 which is fixed to the crankshaft 4. Furthermore, as the internal oil pump drive member 6 is mounted directly on the crankshaft 4, the crank-mounted internal oil pump 2 runs at the same rotational speed as the crankshaft 4. This results in accelerated wear due to friction on the crank-mounted internal oil pump components owing to the pump 2 operating at rotational speeds that exceed its operational requirements. This effect may be particularly evident when a variable flow type pump 2 is used. As a result, of packaging the crank-mounted internal oil pump 2 inside the engine, the crank shaft 4 must have additional length, which in turn extends the overall axial length of the engine 1. In addition to this, any torsional vibrations from the crankshaft 4 are transmitted directly into the crank-mounted internal oil pump 2, thereby decreasing the efficiency and increasing the wear on the components of the oil pump 2.

In the other prior art engine depiction shown in FIG. 2, a remotely mounted oil pump 2R is driven by an oil pump drive member 6 mounted on the crank. By mounting the oil pump 2R remotely from the crankshaft 4, the oil pump 2R may be made smaller than the crank-mounted oil pump 2, since the remotely mounted pump 2R does not need to accommodate the crankshaft 4. Furthermore, the remotely mounted oil pump 2R may be run at a desired rotational speed by selecting appropriate gearing from the crankshaft 4. This reduction in operation speed results in less wear on the internal pump components due to reduced friction and a consequent increase in efficiency, when compared to the crank-mounted oil pump 2. The crankshaft 4, however, still must have additional length to accommodate the internal oil pump drive member 6, which in turn, extends the overall axial length of the engine 1. In addition, torsional vibrations from the crankshaft 4 are still transmitted into the pump 2R from the crank mounted oil pump drive member 6 and any intermediate drive components such as gears or chains. The efficiency and wear characteristics of a remotely mounted oil pump 2R are therefore still not at a desirable level.

Current market trends are driving the demand for smaller vehicles whilst maintaining or increasing the power output and the fuel economy of the vehicle. This means that the size of the engine and how that engine is packaged in the vehicle may be of particular importance in vehicle design. Consequently, the axial length of an engine is important, as it determines the position of the accessory drive with respect to the engine, and hence the spacing from a side rail of the vehicle.

The term accessory drive means the drive arrangement which transmits engine output drive to accessories such as the alternator, power steering pump, air conditioning compressor and cooling fan. The accessory drive may be generally referred to as an external accessory. In some vehicle the accessory drive comprises a dry belt drive, such as a multi-rib belt, to pulleys (not shown) which are connected to the input shaft of respective accessories, and are driven from the crankshaft pulley of the engine. As the underside of the side rail is positioned above the rotational axis of the crankshaft, it is not the direct length of the crankshaft that may affect to engine size, but rather the position of the accessory drive which may affect engine size. It may be advantageous, therefore, for an engine system to package the accessory drive, the oil pump and the oil pump drive member in such a way as to increase (e.g., maximize) the efficiency of both the engine and the oil pump with respect to the prescribed package characteristics of vehicles.

Figure 3:
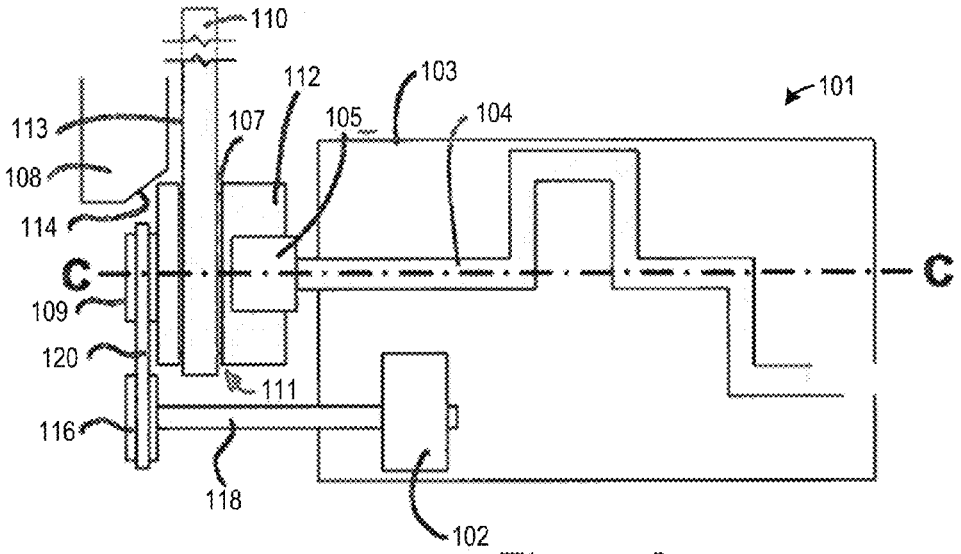
FIG. 3 shows an example engine including an oil pump drive.

FIG. 3 shows an engine 101 having an oil pump 102 and oil pump drive arrangement. It will be appreciated that the engine 101 may be included in a vehicle. The engine 101 comprises a crankshaft 104 mounted for rotation in an engine casing 103. The crankshaft 104 extends through the engine casing 103 and is fitted with a crankshaft pulley 112 by means of a decoupler 105. The crankshaft pulley 112 is provided with a grooved belt drive recess 107 which guides and drives a dry drive belt 111, e.g. a grooved belt, of an accessory drive 110. The crankshaft pulley 112 may be more generally referred to as a drive portion of a drive member. The dry drive belt 111 passes over a plurality of accessory drive pulleys (not shown) of engine accessories such as an alternator, power steering pump, air conditioning compressor and cooling fan, and may be tensioned by one or more idler pulleys (not shown).

An outer face 113 of the belt 111 defines an accessory drive plane, which must have sufficient clearance from the framework into which the engine 101 is fitted. In the illustrated embodiment, the engine is fitted into a vehicle having side rails 108. The accessory drive plane must be spaced sufficiently from the side rail 108 for safe operation, and ideally to allow adequate access for servicing of the engine 101.

A drive member 109 is integrally formed with or attached to an outer face of the crankshaft pulley 112. Therefore, in one example the drive member 109 may include the crankshaft pulley 112 which may also be referred to as a drive portion. It will be appreciated that if the drive member 109 is of a smaller diameter than the crankshaft pulley 112, it is more easily accommodated beneath the side rail 108. This is facilitated if the side rail 108 has a cut away or chamfered portion 114.

In the embodiment illustrated in FIG. 3, the drive member 109 is bolted to the outer face of the crankshaft pulley 112, and drives an input member 116 formed on the end of an oil pump drive shaft 118, by means of a drive element 120. The drive element 120 may, for example, comprise a dry toothed or multi-rib belt, or may be substituted by a chain and corresponding sprockets or by any other suitable drive arrangement, such as a set of gears. In this way, the oil pump 102 may be driven within any desired range of speeds by appropriate selection of the gearing ratio. Still further in other examples, the drive element 120 may be a pulley and/or may be integrated into the drive member 109.

The oil pump drive shaft 118 passes through the engine casing 103 and drives the engine oil pump 102 within a sump of the engine 101. The oil pump drive shaft 118 may be mounted in bearing housings (not shown) in the engine casing 103 and may also be supported by the oil pump 102, if the oil pump 102 is fixed to the engine casing or another static engine component. With the oil pump 102 positioned inside the engine casing 103, it can pick up oil directly from the sump through an oil strainer (not shown) fixed to the body of the oil pump 102.

In another example, the oil pump 102 is mounted outside the engine casing 103, so that there is no longer any requirement to package an oil pump drive member inside the engine, or to transmit drive through the engine casing 103 or sump. By removing the space required inside the engine for an oil pump drive member, the overall package requirements and weight of the engine 101 may be reduced. Consequently, the same output may be achieved from a smaller engine.

Figure 4:
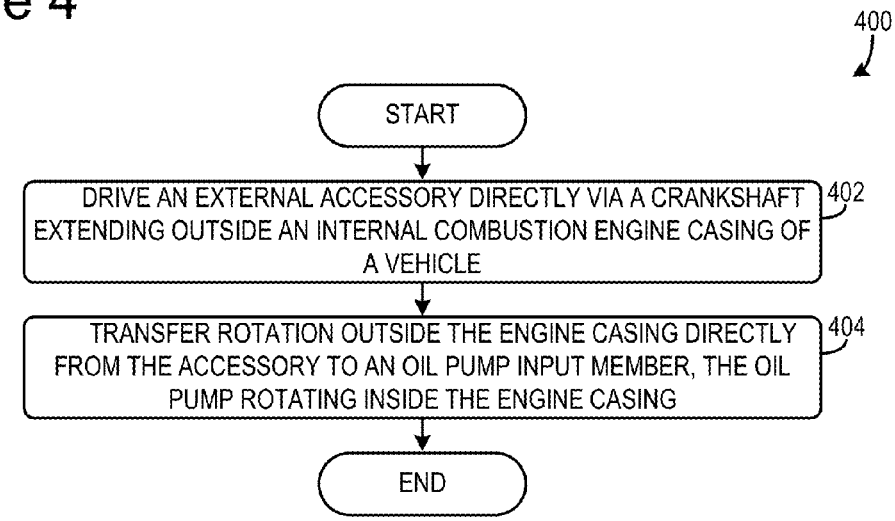
FIG. 4 shows a method for operation of an engine.

FIG. 4 shows a method 400 for operation of an engine. The method may be implemented via the engine 101 and engine components (i.e., oil pump, oil pump input member, crankshaft, etc.,) described above with regard to FIG. 3, in one example. However in another example, the method may be implemented by another suitable engine.

At 402 the method includes driving an external accessory directly via a crankshaft extending outside an internal combustion engine casing of a vehicle. Next at 404 the method includes transferring rotation outside the engine casing directly from the accessory to an oil pump input member, the oil pump rotating inside the engine casing. In this way, the components which drive the oil pump may be positioned external to the engine casing, thereby increasing the compactness of the engine casing.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine comprising:

an engine casing;

a crankshaft extending through the engine casing;

an accessory drive coupled to the crankshaft;

an oil pump having an input member which is driven from the crankshaft at a location on the opposite side of the accessory drive to the engine casing, wherein the input member is driven from a drive member attached to an end of the crankshaft; and a decoupler disposed between the drive member and the crankshaft.

2. The engine according to claim 1, further comprising a drive element which transmits drive from the drive member to the oil pump input member.

3. The engine according to claim 2, wherein the drive element comprises a belt or chain.

4. The engine according to claim 3, wherein the drive element comprises a dry toothed belt.

5. The engine according to claim 4, wherein the drive member comprises a first drive portion which drives the accessory drive and a second drive portion which drives the oil pump input member.

6. The engine according to claim 5, wherein the first drive portion is a first pulley and the second drive portion is a second pulley.

7. The engine according to claim 6, wherein the first pulley is of larger diameter than the second pulley.

8. The engine according to claim 1, wherein the decoupler comprises a flexible coupling, isolator, or one way clutch.

9. The engine according to claim 1, wherein the oil pump input member is disposed below the crankshaft.

10. The engine according to claim 9, wherein the drive member is a crankshaft pulley.

11. The engine according to claim 1, wherein the oil pump input member comprises a drive shaft and a pulley.

12. The engine according to claim 1, wherein the oil pump input member extends through the engine casing.

13. The engine according to claim 1, wherein the oil pump is driven directly by the oil pump input member.

14. An engine comprising:

an engine casing;

a crankshaft extending through the engine casing, an end of the crankshaft outside of the engine casing driving an input member formed on an end of an oil pump drive shaft coupled to an oil pump, wherein the input member is driven from a drive member attached to the end of the crankshaft; and a decoupler disposed between the drive member and the crankshaft.

15. The engine of claim 14, where the drive shaft extending through the engine casing and the oil pump is positioned inside the engine casing.

16. The engine of claim 14, where the oil pump is positioned outside of the engine casing.

17. The engine of claim 14, where the input member is driven from a drive member through a drive element, where the drive element is a pulley.

18. A method, comprising:

driving an external accessory directly via a crankshaft extending outside an internal combustion engine casing of a vehicle; and transferring rotation outside the engine casing directly from the accessory to an oil pump input member, the oil pump rotating inside the engine casing, wherein the oil pump input member is driven from a drive member attached to an end of the crankshaft, and a decoupler is disposed between the drive member and the crankshaft.

* * * * *